US008563316B2

(12) United States Patent
Duffy et al.

(10) Patent No.: US 8,563,316 B2
(45) Date of Patent: Oct. 22, 2013

(54) INERT AND NON-TOXIC EXPLOSIVE SIMULANTS AND METHOD OF PRODUCTION

(75) Inventors: Stephen Francis Duffy, Absecon, NJ (US); Stephen Joseph Goettler, III, Norristown, PA (US); Ronald Arthur Krauss, Galloway, NJ (US)

(73) Assignee: U.S. Department of Homeland Security, Washington, DC (US)

( * ) Notice: Subject to any disclaimer, the term of this patent is extended or adjusted under 35 U.S.C. 154(b) by 141 days.

(21) Appl. No.: 13/182,567

(22) Filed: Jul. 14, 2011

(65) Prior Publication Data

US 2013/0026420 A1 Jan. 31, 2013

(51) Int. Cl.
*G01N 33/22* (2006.01)

(52) U.S. Cl.
USPC ..... 436/8; 252/408.1; 149/109.4; 102/355

(58) Field of Classification Search
USPC ..... 436/18, 8; 252/408.1; 149/109.4; 102/355
See application file for complete search history.

(56) References Cited

U.S. PATENT DOCUMENTS

| | | | | |
|---|---|---|---|---|
| 5,359,936 | A | 11/1994 | Simpson et al. | |
| 5,413,812 | A | 5/1995 | Simpson et al. | |
| 5,648,636 | A | 7/1997 | Simpson et al. | |
| 5,958,299 | A * | 9/1999 | Kury et al. | 252/408.1 |
| 2007/0281358 | A1 | 12/2007 | Cohen-Arazi et al. | |
| 2009/0194744 | A1 * | 8/2009 | Adebimpe | 252/408.1 |

* cited by examiner

*Primary Examiner* — Monique Cole
(74) *Attorney, Agent, or Firm* — Lavanya Ratnam; William Washington

(57) ABSTRACT

The present disclosure describes simulants and methods of production thereof that imitate characteristics of known explosives, including characteristics at the microscopic and macroscopic level. For instance, the present disclosure includes a simulant with the same texture, granularity, bulk density, particle density, and porosity of a known explosive. The simulants described herein provide the macroscopic bulk physical properties and the microscopic scale properties of actual explosives.

12 Claims, 3 Drawing Sheets

| Magnification | Hot Melt Polymer/Wax binder | Volatile Solvent – Urethane binder |
|---|---|---|
| 15X |  |  |
| 60X |  |  |

INERT AND NON-TOXIC EXPLOSIVE SIMULANTS AND METHOD OF PRODUCTION

STATEMENT OF GOVERNMENT INTEREST

The present invention described herein may be manufactured and used by or for the Government of the United States of America for government purposes without the payment of any royalties thereon or therefore.

FIELD OF THE INVENTION

The present invention relates generally to inert and non-toxic explosive simulants. More particularly, the present invention relates to inert and non-toxic solid and liquid explosive simulants that match the microscopic and macroscopic properties of known explosives and methods of production thereof.

BACKGROUND OF THE INVENTION

Current X-ray based explosive detection systems measure the density and effective atomic number (Z-effective number) of materials and compare them to known explosives for detection thereof. Conventional simulants have been developed to match bulk (macroscopic) properties (see, for example, U.S. Pat. No. 5,958,299 to Kury et al.). Simulants are used for testing and training purposes on explosive detection systems (EDS) were the use of live explosives may pose a safety risk, are prohibited, or are otherwise impractical. That is, explosive simulants are required to mimic a variety of factors associated with an actual explosive device such as, for example, shape, texture, weight, density, and the like. Such explosive simulants are required to pass for actual explosives during testing and training while posing no actual harm. There exists a need to provide explosive simulants which have the macroscopic bulk physical properties as well as the microscopic scale properties of explosives. Such explosive simulants should appear to explosive detection systems as real explosives.

BRIEF SUMMARY OF THE INVENTION

In various exemplary embodiments, the present invention describes simulants and methods of production thereof that imitate characteristics of known explosives, including characteristics at the microscopic and macroscopic level. The present invention described herein provides a new approach to simulant production in which microscopic, liquid, and novel macroscopic properties are matched in order to simulate a more dynamic ranged or material properties and behavior. For instance, the present disclosure includes a simulant with the same texture, granularity, bulk density, particle density, and porosity of a known explosive. The simulants described herein provide the macroscopic bulk physical properties and the microscopic scale properties of actual explosives. The simulants described herein may be used to evaluate explosive detection system performance as well as to provide safe training materials for users of the technology, such as Transportation Security Administration (TSA) Officers during baggage screening, military training applications, and the like.

According to an exemplary embodiment of the present invention, a process of preparing a crystal density simulant that imitates the properties of an explosive includes reproducing microscopic features of a known explosive in a controlled manner, while maintaining the overall macroscopic target density and z-effective number of the simulant. The microscopic features may include texture, granularity, and density. The process of preparing the crystal density simulant may further include allowing the simulant to absorb a volatile solvent, causing the simulant to swell, and drying the simulant. Optionally, the process of preparing the crystal density simulant may further include adding a urethane binder to the simulant. Alternatively, the process for preparing the crystal density simulant may further include adding a polymer/wax binder to the simulant.

According to another exemplary embodiment of the present invention, a process for preparing a simulant includes blending dry powder materials in a tool and die set to form a mixture, compressing the mixture with 40 tons of force to fuse the mixture together, and forming a solid object from the mixture. The process of preparing the simulant may further include tooling the mixture to obtain a predetermined solid object. The process of preparing the simulant may further include matching the bulk density of the simulant to the bulk density of a known explosive. The process of preparing the simulant may further include matching the particle density of the simulant to the particle density of a known explosive. The process of preparing the simulant may further include matching the porosity of the simulant to the porosity of a known explosive.

According to yet another exemplary embodiment of the present invention, a liquid simulant that imitates the characteristics of a known explosive includes glycerin in the range from 68 to 93 wt % and corn syrup in the range from 24.9 to 95.4 wt %. The liquid simulant may further include water in the range from 2.3 to 59.7 wt %. The liquid simulant may further include potassium iodide in the range of from 0.1 to 0.2 wt %. The liquid simulant may yet further include sodium chloride in the range of from 0 to 2.35 wt %. The liquid simulant may yet further include sorbitol solution (70% aqueous) in the range of from 22 to 50 wt %. The liquid simulant may yet further include 83.65 wt % of glycerin, 0.14 wt % of water and 2.35 wt % of sodium chloride.

According to yet another exemplary embodiment of the present invention, a z-density parametric set for testing new explosive detection systems includes inert and non-toxic samples that have densities from 0.65 to 2.00 glee and z-effective values from 7 to 13.50. The z-density parametric set may also include glycerin in the range of from 0.00 to 43.5 wt %, iron oxide in the range from 0.57 to 17.5 wt %, boron carbide in the range from 4.00 to 70.60 wt %, polyethylene in the range from 0.00 to 66.42 wt %, carbopol in the range from 0.00 to 1.39 wt %, and a 50% solution of sodium hydroxide in the range from 0.00 to 1.05 wt %, including all points in-between.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
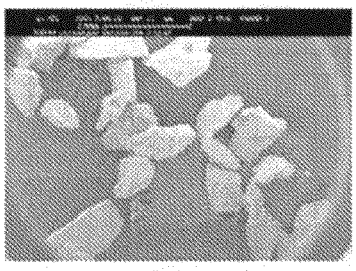
FIG. 1 are scanning electron microscope (SEM) images of Triacetone Triperoxide (TATP) particle density simulants.
Figure 1:
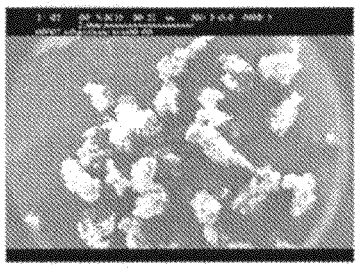
Figure 1:
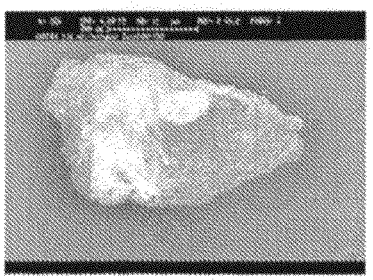
Figure 1:
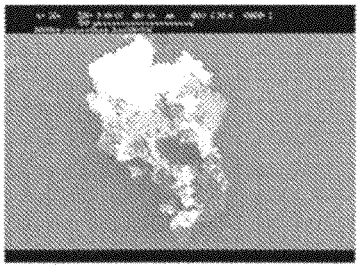

In various exemplary embodiments, the present invention describes simulants and methods of production thereof that imitate characteristics of known explosives, including characteristics at the microscopic and macroscopic level. The present invention described herein provides a new approach to simulant production in which microscopic, liquid, and novel macroscopic properties are matched in order to simulate a more dynamic ranged or material properties and behavior. For instance, the present disclosure includes a simulant with the same texture, granularity, bulk density, particle density, and porosity of a known explosive. The simulants described herein provide the macroscopic bulk physical properties and the microscopic scale properties of actual explosives. The simulants described herein may be used to evaluate explosive detection system performance as well as to provide safe training materials for users of the technology, such as Transportation Security Administration (TSA) Officers during baggage screening, military training applications, and the like.

An exemplary embodiment of the present invention discloses a crystal density simulant that allows microscopic features of certain explosives, such as texture, granularity, and density distributions to be reproduced in a controlled manner, while still maintaining the overall (bulk or macroscopic) target density and Z-effective number of the simulant. Another exemplary embodiment of the present invention relates to a process for producing a pressed explosive simulant that has unique compositions of matter Which imitate select bulk physical properties of cast and pressed explosives. The final shape of the pressed explosive simulant can be tooled to have a final form of Trinitrotoluene (TNT), Composition-B, and the like. The simulant may also be in the form of a liquid explosive simulant. The liquid explosive simulant would aid in the measuring and recalibrating the detection limits of X-ray based explosive detection systems (EDS). The X-ray EDS are in widespread use by the Transportation Security Administration (TSA) and other security services. The liquid explosive simulant is also a safe training tool for the baggage screeners that also use these X-ray explosive detection systems.

The crystal density explosive simulant is intended to imitate select physical properties of explosives at their microscopic level. Physical properties of various explosive particles are studied at their microscopic level. Inert ingredients were then blended and processed to produce simulants that match the crystal density, effective atomic number and particle size of the explosive compounds. By matching of the properties of explosives at the microscopic level, a more dynamic range of mechanical, structural, and physical bulk properties can be simulated using safe, inert materials. The process of selecting physical properties of explosives at the microscopic level have helped develop particle density simulants to match the dynamic crystalline and bulk powder properties of explosives such as triacetone triperoxide (TATP), hexamethylene triperoxide (HMTD), nitrocellulose based smokeless powder (SP), potassium nitrate based black powder (BP) and ammonium nitrate prills and powders (AN).

Figure 2:
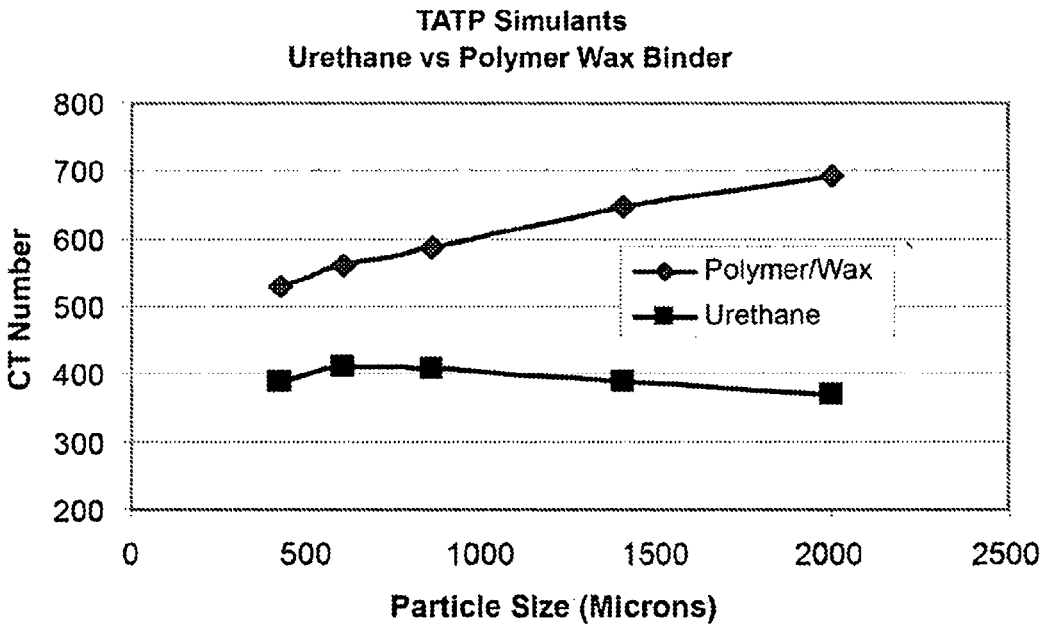
FIG. 2 is a graph comparing Triacetone Triperoxide (TATP) simulant formulas using either a urethane or a polymer/wax binder.

The surface properties and morphology of the crystal density explosive simulant can be modified by the addition of a volatile or non-volatile binder. The binder is utilized to combine the dry ingredients into a material that achieves the desired properties of a target explosive. For example, an analysis was conducted of different particle density simulant formulations for TATP to examine the effects on the bulk properties with the addition different type of binder. As illustrated in FIG. 2, urethane and a polymer/wax were utilized as the binder. The results as shown in FIG. 2 indicate that the use of the two different binders exhibited very different packed densities and the computed tomography (CT) numbers varied. Every crystal density simulant will include a binder and the binder selected for the particular simulant will influence the final properties.

As illustrated in FIG. 2, the particles have different morphologies due to the use of a volatile solvent binder in one case, and a hot-melt polymer/wax binder in the other case. This was further examined by preparing samples for scanning electron microscopy (SEM). As illustrated in FIG. 1, a much more porous structure results from the evaporation of a volatile solvent (urethane) binder as compared to the hot-melt polymer/wax binder. A porous structure has also been obtained by treating a polymer/wax binder formula with a volatile solvent, and allowing the structure to absorb the volatile solvent, swell, and then dry out. This results in a much more irregularly shaped particle after solvent treatment. The irregularly shaped particles pack together much less efficiently, thus resulting in a lower powder density. In addition to controlling the particle density, Z-effective, and particle size distribution, this process has also been used to adjust the overall bulk properties of simulants to match different target explosives more closely.

Figure 3:
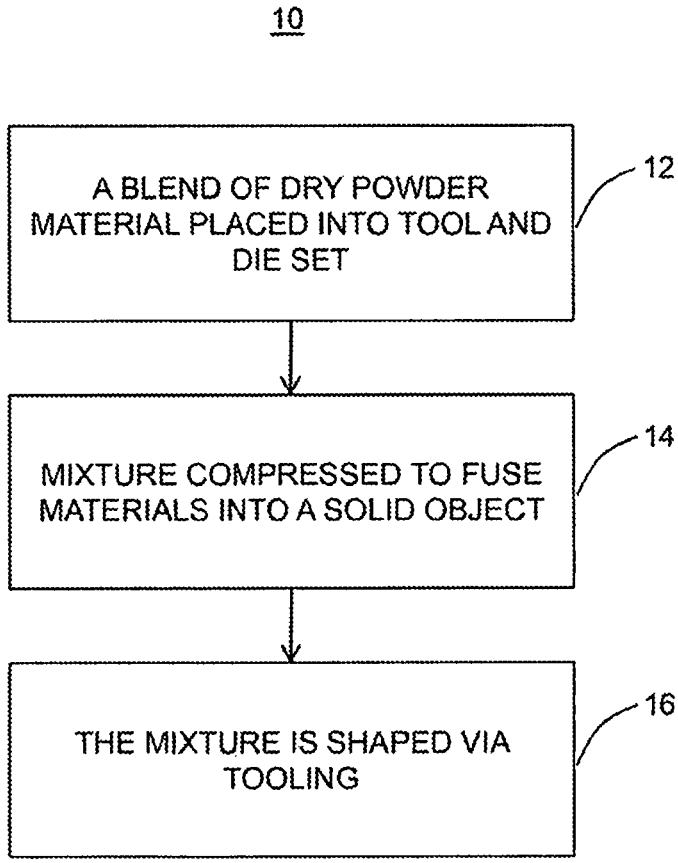
FIG. 3 is a flowchart of a process for producing unique simulant compositions of matter that imitate the bulk physical properties of cast and pressed explosives.

Referring to FIG. 3, according to another exemplary embodiment of the present invention, a process 10 has been developed to produce unique simulant compositions of matter that imitate the bulk physical properties of cast and pressed explosives. The simulants are inert and non-toxic and imitate select physical properties of explosives.

In producing the simulant, a blend of dry powder materials is placed into a custom made tool and die set forming a mixture (step 12). The mixture is then compressed with about 40 tons of force to fuse the materials together into a solid object (step 14). The mixture is selected to produce a simulant that has a predetermined particle density, bulk density, porosity, and effective atomic number. The final formula must balance the amount of binder, high density solids, low density filler and small amounts of metal or salt compounds to simultaneously match all of the desired properties for the finished product. The shape of the finished product is determined by tooling (step 16). Different tool sets have been developed to match different configurations of military explosives, such as the M15 and M45 US military cartridge configurations and Russian TNT cartridges. The process 10 described herein has been successful in developing inert, high fidelity simulants for TNT as well as Pentaerythritol tetranitrate (PETN)/cyclotrimethylenetrinitramine (RDX) cast booster and Composition-B. The process 10 is suitable for a range of pressed and cast explosives.

Porosity is defined as:

$$\Phi = 1 - \left(\frac{\text{Bulk_density}}{\text{Particle_density}}\right)$$

Porosity is used to describe the amount of void space inside a solid material. In the present invention, a user may match the porosity of an explosive with an inert x-ray simulant to improve the fidelity and performance of the simulant over existing formulation technology.

When the bulk density, particle density, and porosity of an explosive is matched, the bulk physical properties and x-ray properties of the simulant match more Closely than the current commercial simulants. Comparative data for a new pressed TNT simulant vs. a current commercial TNT simulant is summarized in Table 1 below.

TABLE 1

| Bulk Physical Properties | US Military TNT | Pressed Simulant TNT-16 | Comparative Example |
|---|---|---|---|
| Bulk Density | 1.46 | 1.44 | 1.56 |
| Particle Density | 1.63 | 1.62 | 1.52 |
| Porosity | 10.4% | 11.1% | 0% |
| X-ray Properties | | | |
| Z-effective | 7.91 | 7.92 | 7.30 |
| CT Number (Hounsfield units) | 1327 | 1359 | 1445 |
| Percent CT deviation | 1.93% | 1.30% | 0.88% |

As shown in Table 1, there is a significant improvement of the simulant of the present invention over the comparative example, which is currently available.

According to another exemplary embodiment of the present invention, a novel process has been developed to produce an inert, non-toxic liquid mixture that reproduces the same bulk physical property as liquid explosives. The liquid mixture, when run through an x-ray based explosive detection system, matches the same physical bulk properties exhibited by various liquid explosives. For example, hydrogen peroxide is used by terrorists and should be detected by explosive detection systems to thwart terrorist activities. The process of the present invention has developed four different simulant formulations for a hydrogen peroxide simulant. The four formulations are for 50%, 65%, 70%, and 90% hydrogen peroxide solutions. The simulants are composed of glycerin in the range of from 68 to 93 wt %, including all points in-between, or corn syrup in the range of from 76 to 95.4 wt %, including all points in-between. The simulant also may contain water in a range from 2.3 to 29.55 wt %, including all points in-between, and potassium iodide in the range from 0.1 to 0.2 wt %, including all points in-between or potassium acetate in the range from 1.8 to 3.3 wt %.

Nitromethane is also used by terrorists to make a home-made explosive (HME). The process of the present invention was used to develop a simulant for nitromethane that consists of from 0 to 18 wt % of propylene glycol, including all points in-between, sorbitol solution (70% aqueous) in the range from 22 to 50 wt %, including all points in-between, water in the range from 49.7 to 59.7 wt %, including all points in-between, and Phenonip® preservative from 0 to 0.3 wt %, including all points in-between.

The process of the present invention was utilized in an exemplary embodiment to develop a simulant for Methyl nitrate, which is a liquid explosive. The simulant includes 83.65 wt % of glycerin, 14 wt % of water, and 2.35 wt % sodium chloride. The methyl nitrate simulant matches the same physical bulk properties as methyl nitrate.

The process of the present invention was also utilized in an exemplary embodiment to manufacture a simulant for methyl ethyl ketone peroxide (MEKP). The simulant contains 75.1 wt % propylene glycol and 24.9% corn syrup. The MEKP simulant substantially matches the same physical bulk properties of MEKP.

In another exemplary embodiment of the present invention, a z-density parametric simulant set may be utilized to efficiently and expeditiously test new explosive detection systems before going on-line. The z-density parametric simulant set is comprised of 82 unique inert and non-toxic gel-like and powder blend samples that vary in density from a range of 0.65 to 2.00 glee, including all points in-between, and effective values of from 7 to 13.50, including all points in-between. In determining the exact chemical composition of the z-density parametric simulants, the X-ray attenuation characteristics can be calculated and compared to the attenuation measured directly by an explosive detection system. After the calculation and comparison, this allows a correlation of explosive detection system detection performance to the attenuation characteristics of materials, as well as providing a comparison of the measured to the calculated attenuation characteristics.

The 82 parametric formulations are made up of a blend of a number of materials that include: glycerin in the range of from 0.00 to 43.5 wt %, including all points in-between; iron oxide in the range from 0.57 to 17.5 wt %, including all points in-between; boron carbide in the range from 4.00 to 70.60 wt %, including all points in-between; polyethylene in the range from 0.00 to 66.42 wt %, including all points in-between; carbopol in the range from 0.00 to 1.39 wt %, including all points in-between; and a 50% solution of sodium hydroxide in the range from 0.00 to 1.05 wt %, including all points in-between.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A process of preparing a crystal density simulant that imitates the properties of an explosive, comprising:

reproducing microscopic features of a known explosive in a controlled manner by selecting inert materials for the simulant that have a predetermined particle density, bulk density, porosity, and effective atomic number to imitate the known explosive, while maintaining the overall macroscopic target density and z-effective number of the stimulant; and blending and compressing the selected inert materials to form the stimulant which is inert while matching macroscopic bulk physical properties and the microscopic scale properties of the known explosive;

wherein the microscopic features comprise texture, granularity, density, and porosity.

2. The process of preparing the crystal density simulant of claim 1, further comprising allowing the simulant to absorb a volatile solvent, causing the simulant to swell, and drying the stimulant.

3. The process of preparing the crystal density simulant of claim 1, further comprising;

adding a urethane binder to the stimulant.

4. The process for preparing the crystal density simulant of claim 1, further comprising:

adding a polymer/wax binder to the simulant.

5. The process for preparing the crystal density simulant of claim 1, further comprising:

adding a binder to the selected inert materials to achieve the macroscopic bulk physical properties and the microscopic scale properties of the known explosive subsequent to the blending and compressing step.

6. The process for preparing the crystal density simulant of claim 5, wherein the binder comprises one of urethane or a polymer/wax, wherein the binder comprises urethane for a more porous structure relative to using the polymer/wax as the binder.

7. The process for preparing the crystal density simulant of claim 1, further comprising:

selecting inert materials comprising balancing an amount of binder, high density solids, low density filler, and small amounts of metal or salt compounds to simultaneously match all of the macroscopic bulk physical properties and the microscopic scale properties of the known explosive.

8. The process for preparing the crystal density simulant of claim 7, further comprising:

compressing the selected inert materials with about 40 tons of force to fuse the selected inert materials together into a solid object; and tooling the solid object to match a configuration of the known explosive.

9. The process for preparing the crystal density simulant of claim 7, wherein the macroscopic bulk physical properties and the microscopic scale properties of the known explosive comprise bulk density, particle density, porosity, Z-effective, and CT number.

10. The process for preparing the crystal density simulant of claim 7, wherein the binder is selected from a plurality of different types of binder to adjust the porosity of the simulant as required to match the porosity of the known explosive.

11. The process for preparing the crystal density simulant of claim 7, wherein the known explosive comprises one of triacetone triperoxide (TATP), hexamethylene triperoxide diamine (HMTD), nitrocellulose based smokeless powder (SP), potassium nitrate based black powder (BP) and ammonium nitrate prills and powders (AN).

12. A process of preparing a crystal density simulant that imitates the properties of a known explosive, comprising:

determining physical properties of explosive particles of the known explosive at a microscopic level, wherein the physical properties comprise texture, granularity, density, and porosity;

selecting inert materials to reproduce the physical properties of the explosive particles at the microscopic level, wherein the selecting comprises balancing an amount of binder, high density solids, low density filler, and small amounts of metal or salt compounds to simultaneously match all of the physical properties comprising macroscopic bulk physical properties and microscopic scale properties of the known explosive, utilizing the binder to adjust shapes of the high density solids; and blending and compressing the selected inert materials to form the simulant which is inert while matching macroscopic bulk physical properties and the microscopic scale properties of the known explosive, wherein the shapes of the high density solids are adjusted such that the simulant matches the porosity of the known explosive subsequent to the blending and compressing.

* * * * *